US006390787B1

(12) United States Patent
Herder

(10) Patent No.: US 6,390,787 B1
(45) Date of Patent: May 21, 2002

(54) TAPERED SWASH PLATE

(75) Inventor: David H. Herder, Plymouth, MI (US)

(73) Assignee: Visteon Global Technologies Inc., Dearborn, MI (US)

( * ) Notice: Subject to any disclaimer, the term of this patent is extended or adjusted under 35 U.S.C. 154(b) by 0 days.

(21) Appl. No.: 09/732,001

(22) Filed: Dec. 7, 2000

(51) Int. Cl.[7] ..... F04B 1/12; F04B 1/26; F04B 3/00

(52) U.S. Cl. ..... 417/269; 417/222.2; 92/71; 92/12.2

(58) Field of Search ..... 417/269, 222.2; 92/71, 12.2

(56) References Cited

U.S. PATENT DOCUMENTS 3,968,699 A 7/1976 Van Beukering ..... 74/60
4,273,518 A * 6/1981 Shibuya ..... 417/269
5,547,346 A * 8/1996 Kanzaki et al. ..... 417/222.2
5,641,038 A * 6/1997 Akamatsu ..... 417/269
5,882,179 A 3/1999 Ota et al. ..... 417/222.2

* cited by examiner

*Primary Examiner*—Charles G. Freay
*Assistant Examiner*—Michael K. Gray
(74) *Attorney, Agent, or Firm*—Larry I. Shelton

(57) ABSTRACT

A variable displacement swash plate type compressor which incorporates a swash plate slidably mounted on a drive shaft, the swash plate having side walls that taper toward one another for constant point contact with a ball bearing of an associated piston which results in a smaller required diameter for the swash plate and smoother operation of the compressor over prior art structures.

6 Claims, 2 Drawing Sheets

TAPERED SWASH PLATE

FIELD OF THE INVENTION

The present invention relates to a variable displacement swash plate type compressor adapted for use in an air conditioning system for a vehicle, and more particularly to a tapered swash plate which effectively causes constant bearing contact between the swash plate and the associated pistons during any changes in the inclination of the swash plate.

BACKGROUND OF THE INVENTION

Variable displacement swash plate type compressors typically include a cylinder block provided with a number of cylinders, a piston disposed in each of the cylinders of the cylinder block, a crankcase sealingly disposed on one end of the cylinder block, a rotatably supported drive shaft, and a swash plate. The swash plate is adapted to be rotated by the drive shaft. The rotation of the swash plate is effective to reciprocatively drive the pistons. The length of the stroke of the pistons is varied by the inclination of the swash plate.

In the prior art, a variety of structures have been disclosed for operatively connecting the swash plate and the pistons. Typically, a pair of semi-spherical shoes is disposed in a bridge portion of the pistons and slidingly engages a swash plate of uniform thickness. Specifically, the flat bearing surface of a semi-spherical shoe slidably engages the swash plate, with the spherical surface typically disposed in a concave shoe pocket in the bridge portion of each piston. As the swash plate is caused to slide along the flat bearing surface of the semi-spherical shoes of the pistons, friction is created causing undesirable heat and wear.

Prior art structures typically include a swash plate having machined surfaces adapted to engage the entire flat bearing surfaces of the semi-spherical shoes. A disadvantage of the prior art is that the swash plate must be of a specified diameter and weight to support the surface area of the semi-spherical shoes of the pistons. The flat bearing surfaces of the shoes must be polished, adding expense. In addition, the polished surfaces may also require surface hardening adding even more expense.

An object of the present invention is to produce a swash plate type compressor wherein the contacting surface area between the swash plate and each shoe is minimized thereby minimizing friction, heat, and wear.

SUMMARY OF THE INVENTION

The above, as well as other objects of the present invention, may be readily achieved by a variable displacement swash plate type compressor comprising: a cylinder block having a plurality of cylinders arranged radially therein; a plurality of pistons, each of the pistons reciprocatively disposed in each of the cylinders of the cylinder block; a cylinder head attached to the cylinder block and cooperating with the cylinder block to define an airtight seal; a crankcase attached to the cylinder block and cooperating with the cylinder block to define an airtight sealed crank chamber; a drive shaft rotatably supported by the crankcase and the cylinder block in the crank chamber; bearing means disposed in a bridge portion of the pistons; and a swash plate adapted to be driven by the drive shaft, the swash plate having a central aperture, opposing sides, and a peripheral edge, the drive shaft extending through the aperture of the swash plate the opposing sides of the swash plate having tapered surfaces intermediate the central aperture and. the peripheral edge, the tapered surfaces causing the swash plate to remain in constant bearing contact with the bearing means as the inclination of the swash plate changes.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
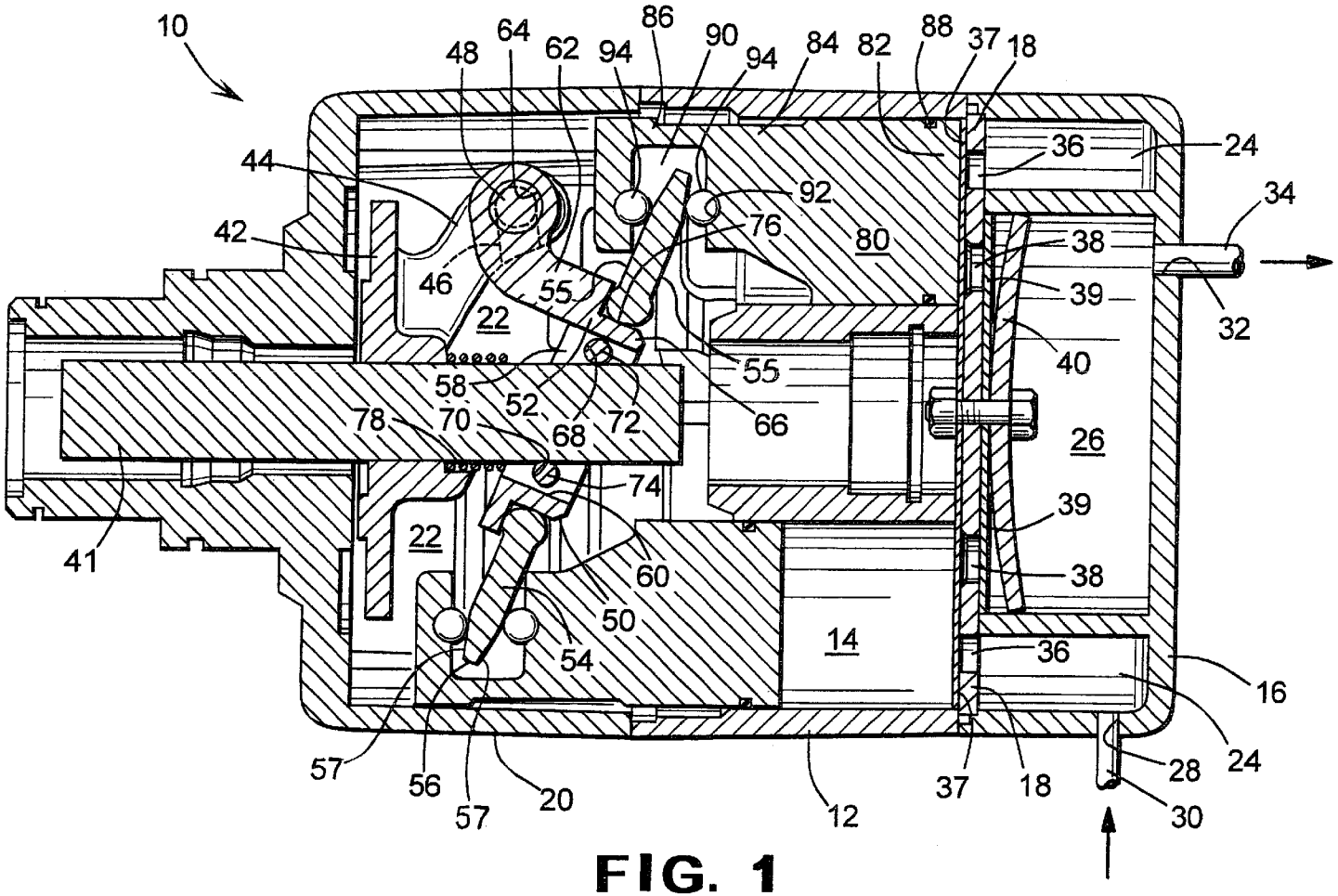
FIG. 1 is a cross sectional elevational view of a variable displacement swash plate type compressor incorporating the features of the invention and showing the swash plate at a maximum inclination.

Referring now to the drawings, and particularly FIG. 1, there is shown generally at 10 a variable displacement swash plate type compressor incorporating the features of the invention. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 is sealingly disposed at the other end of the cylinder block 12. The crankcase 20 and cylinder block 12 cooperate to form an airtight crank chamber 22.

The cylinder head 16 includes a suction chamber 24 and a discharge chamber 26. An inlet port 28 and associated inlet conduit 30 provide fluid communication between the heat exchanger (not shown) of the cooling portion of the air conditioning system for a vehicle and the suction chamber 24. An outlet port 32 and associated outlet conduit 34 provide fluid communication between the discharge chamber 26 and the cooling portion of the air conditioning system for a vehicle. Suction ports 36 provide fluid communication between the suction In chamber 24 and each cylinder 14. Each suction port 36 is opened and closed by a suction valve 37. Discharge ports 38 provide fluid communication between each cylinder 14 and the discharge chamber 26. Each discharge port 38 is opened and closed by a discharge valve 39. A retainer 40 restricts the opening of the discharge valve 39.

A drive shaft 41 is centrally disposed in and arranged to extend through the crankcase 20 to the cylinder block 12. The drive shaft 41 is rotatably supported in the crankcase 20.

A rotor 42 is fixedly mounted on an outer surface of the drive shaft 41 adjacent one end of the crankcase 20 within the crank chamber 22. An arm 44 extends outwardly from a surface of the rotor 42 opposite the surface of the rotor 42 that is adjacent the end of the crankcase 20. A slot 46 is formed in the distal end of the arm 44. A pin 48 has one end slidingly disposed in the slot 46 of the arm 44 of the rotor 42.

A swash plate 50 is formed to include a hub 52 and a tapered annular plate 54. The annular plate 54 has side walls or opposing sides 55, and a peripheral marginal edge 56, the opposing sides 55 being tapered at tapered portions 57 intermediate the hub 52 and the marginal edge 56. The hub 52 includes an annular main body 58 with a centrally disposed aperture 60 formed therein and an arm 62 that extends outwardly and perpendicularly from the surface of the hub 52. An aperture 64 is formed in the distal end of the arm 62 of the hub 52. One end of the pin 48 is slidingly disposed in the slot 46 of the arm 44 of the rotor 42, while the other end is fixedly disposed in the aperture 64 of the arm 62.

A hollow annular extension 66 extends from the opposite surface of the hub 52 as the arm 62. Two holes 68, 70 are formed in the annular extension 66 of the hub 52. Two pins 72, 74 are disposed in the holes 68, 70, respectively, with a portion of the outer surface of the pins 72, 74 extending inwardly within the hollow annular extension 66 of the hub 52.

The annular plate 54 has a centrally disposed aperture 76 formed therein to receive the annular extension 66 of the hub 52. The annular extension 66 is press fit in the aperture 76 of the annular plate 54. The drive shaft 41 is adapted to extend through the hollow annular extension 66.

A helical spring 78 is disposed to extend around the outer surface of the drive shaft 41. One end of the spring 78 abuts the rotor 42, while the opposite end abuts the hub 52 of the swash plate 50.

A piston 80 is slidably disposed in each of the cylinders 14 in the cylinder block 12. Each piston 80 includes a head 82, a middle portion 84, and a bridge portion 86. A circumferential groove 88 is formed in an outer cylindrical wall of the head 82 to receive piston rings (not shown). The middle portion 84 terminates in the bridge portion 86 defining an interior space 90 for receiving the peripheral marginal edge 56 of the annular plate 54. Spaced apart concave pockets 92 are formed in the interior space 90 of the bridge portion 86 for rotatably containing ball bearings 94, as clearly illustrated in FIGS. 1 and 2. It will be understood that other embodiments of the present invention may include a bearing element of another shape such as, for example, semi-spherical, cylindrical, or elliptical.

The operation of the compressor 10 is accomplished by rotation of the drive shaft 41 by an auxiliary drive means (not shown), which may typically be the internal combustion engine of a vehicle. Rotation of the drive shaft 41 causes the rotor 42 to correspondingly rotate with the drive shaft 41. The swash plate 50 is connected to the rotor 42 by a hinge mechanism formed by the pin 48 slidingly disposed in the slot 46 of the arm 44 of the rotor 42 and fixedly disposed in the aperture 64 of the arm 62 of the hub 52. As the rotor 42 rotates, the connection made by the pin 48 between the swash plate 50 and the rotor 42 causes the swash plate 50 to rotate. During rotation, the swash plate 50 is disposed at an inclination. The rotation of the swash plate 50 is effective to reciprocatively drive the pistons 80. The rotation of the swash plate 50 further causes a rolling engagement between the opposing sides 55 of the annular plate 54 and the cooperating spaced apart ball bearings 94.

The capacity of the compressor 10 can be changed by changing the inclination of the swash plate 50 and thereby changing the length of the stroke for the pistons 80.

A control valve (not shown) is arranged to monitor the suction and discharge pressures of the compressor 10, and control the flow of refrigerant gas from the discharge chamber 26 to the crank chamber 22 through a conduit (not shown). Specifically, when an increase in thermal load occurs, the control valve is caused to close, thereby stopping the flow of refrigerant gas through the control valve to the crank chamber 22. The pressure differential between the crank chamber 22 and the suction chamber 24 is then equalized by bleeding refrigerant gas through an orifice (not shown) to the suction chamber 24. As a result of the decreased backpressure acting on the pistons 80 in the crank chamber 22, the pin 48 connecting the rotor 42 and the swash plate 50 is caused to move slidably and outwardly within the slot 46. The swash plate 50 is moved against the force of the spring 78, the inclination of the swash plate 50 is increased, and as a result, the length of the stroke of each piston 80 is increased.

Conversely, when a decrease in thermal load occurs, the control valve is caused to open, thereby bleeding refrigerant gas from the discharge chamber 26 to the crank chamber 22 through the conduit. Because the flow of pressurized refrigerant gas to the crank chamber 22 from the discharge 26 is larger than the flow of refrigerant gas from the crank chamber 22, to the suction chamber 24, through the orifice, the backpressure acting on the pistons 80 in the crank chamber 22 is increased. As a result of the increased backpressure in the crank chamber 22, the pin 48 is moved slidably and inwardly within the slot 46. The swash plate 50 yields to the force of the spring 78, the inclination of the swash plate 50 is decreased, and as a result, the length of the stroke of each piston 80 is reduced.

Figure 2:
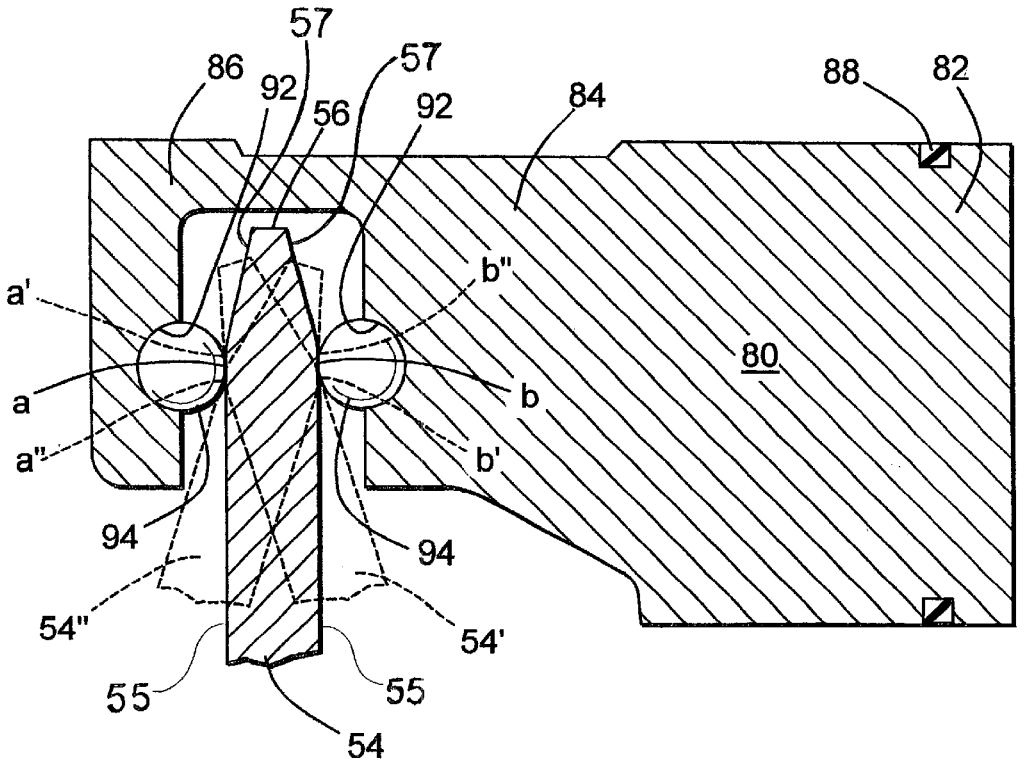
FIG. 2 is a partial cross sectional view of the swash plate type compressor illustrated in FIG. 1 showing the ball bearings, the swash plate at a minimum inclination, the radially outwardly extending tapered side walls, and phantom lines illustrating the swash plate at a maximum inclination when the piston is at a top dead center position and at a bottom dead center position.

During rotation of the swash plate 50, each piston 80 is caused to move from a top dead center position to a bottom dead center position in respect of each cooperating cylinder 14. FIG. 2 illustrates the annular plate 54 at a minimum inclination; the annular plate 54' at a maximum inclination when the piston 80 is at a bottom dead center position; and the annular plate 54" at a maximum inclination when the piston 80 is at a top dead center position.

As further illustrated in FIG. 2, the opposing sides 55 of the annular plate 54 are tapered at tapered portions 57 such that the opposing sides 55 are in constant rolling contact with the adjacent ball bearings 94 at all swash plate 50 inclinations. For example, at a minimum inclination, the annular plate 54 contacts the ball bearings 94 at engagement points a and b. When the swash plate 50 is at a maximum inclination and the piston 80 is at a bottom dead center position, the annular plate 54' contacts the ball bearings 94 at engagement points a' and b'. Additionally, when the swash plate 50 is at a maximum inclination and the piston 80 is at a top dead center position, the annular plate 54" contacts the ball bearings 94 at engagement points a" and b". Therefore, as the swash plate 50 rotates, each piston 80 is caused to move from a top dead center position to a bottom dead center position, and the inclination of the swash plate 50 relative to each piston 80 changes. The opposing sides 55 of the annular plate 54 therefore allow the annular plate 54 to travel freely between the ball bearings 94 while remaining in constant contact with the ball bearings 94 as the swash plate 50 rotates.

Further, because the opposing sides 55 of the annular plate 54 remain in constant contact with the bearings 94 as the inclination of the swash plate 50 changes, the bearings 94 are caused to remain rotatably contained in the pockets 92, thus minimizing vibration and wear of the bearings 94 and the associated pockets 92.

Additionally, the use of ball bearings 94 as the bearing means minimizes the contacting surface area between the opposing sides 55 of the annular plate 54 and the ball bearings 94. The reduced contacting surface area minimizes frictional engagement, thereby minimizing the resultant heat and wear of the annular plate 54 and the associated bearings 94. Further, the tapered shape of the tapered portions 57 of the annular plate 54 reduces the amount of material required to manufacture the annular plate 54, thereby minimizing material costs and the overall weight of the compressor 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable displacement swash plate type compressor comprising:

a cylinder block having a plurality of cylinders arranged radially therein;

a plurality of pistons, each of said pistons reciprocatively disposed in each of the cylinders of said cylinder block;

a cylinder head attached to said cylinder block;

a crankcase attached to said cylinder block and cooperating with said cylinder block to define a crank chamber;

a drive shaft rotatably supported by said crankcase and said cylinder block in the crank chamber;

bearing means disposed in a bridge portion of said pistons; and a swash plate adapted to be driven by said drive shaft, said swash plate having a central aperture, opposing sides, and a peripheral edge, said drive shaft extending through the aperture of said swash plate, the opposing sides of said swash plate having tapered surfaces intermediate the central aperture and the peripheral edge, the tapered surfaces causing said swash plate to remain in constant bearing contact with said bearing means as the inclination of said swash plate changes.

2. The compressor according to claim 1, wherein said bearing means are ball bearings.

3. The compressor according to claim 2, wherein each said piston includes a pair of concave pockets for receiving said ball bearings.

4. A swash plate for a variable displacement swash plate type compressor, the compressor having a drive shaft, a plurality of pistons with a pair of concave ball bearing pockets formed within each piston, and a pair of ball bearings disposed within the ball bearing pockets, comprising:

an annular plate having a centrally disposed drive shaft receiving aperture and radially outwardly extending side walls, said side walls having tapered portions adjacent a marginal edge of said plate, whereby when said plate is positioned between the ball bearings of the pistons, at least one of said tapered portions is caused to contact an adjacent one of the ball bearings as an inclination angle of said plate is changed.

5. The swash plate according to claim 4, wherein the side walls of said plate taper towards one another.

6. A variable displacement swash plate type compressor comprising:

a cylinder block having a plurality of cylinders arranged radially therein;

a crankcase attached to said cylinder block and cooperating with said cylinder block to define a crank chamber;

a cylinder head attached to said cylinder block, said cylinder head having a suction chamber and a discharge chamber formed therein;

a drive shaft rotatably supported by said crankcase and said cylinder block in the crank chamber, said drive shaft operatively coupled to an auxiliary drive means;

a rotor mount fixedly mounted on said drive shaft;

a swash plate adapted to be driven by said drive shaft, said swash plate having a central aperture, radially outwardly extending side walls, and a peripheral edge, said drive shaft extending through the aperture of said swash plate, the side walls of said swash plate tapering toward one another, the tapered side walls causing said swash plate to remain in constant bearing contact with an associated bearing means as the inclination of said swash plate changes;

a hinge means disposed between said rotor mount and said swash plate for changing the inclination of said swash plate;

a plurality of pistons reciprocatively disposed in each cylinder of said cylinder block, each of said pistons having a cylindrical body with a head, a middle portion, and a bridge portion, the bridge portion having an interior space for receiving the peripheral marginal edge of said swash plate, and a pair of ball bearing pockets formed within the interior space of the bridge portion; and said bearing means including ball bearings disposed within the ball bearing pockets of each said piston.

* * * * *